US008824909B2

(12) United States Patent
Kamiyama

(10) Patent No.: US 8,824,909 B2
(45) Date of Patent: Sep. 2, 2014

(54) IMAGE FORMING APPARATUS USING TWO-COMPONENT DEVELOPER AND HAVING CONTROLLED TIMING OF APPLICATION OF VOLTAGE TO MAGNETIC ROLLER

(75) Inventor: Yuji Kamiyama, Osaka (JP)

(73) Assignee: Kyocera Document Solutions Inc. (JP)

( * ) Notice: Subject to any disclaimer, the term of this patent is extended or adjusted under 35 U.S.C. 154(b) by 230 days.

(21) Appl. No.: 13/492,056

(22) Filed: Jun. 8, 2012

(65) Prior Publication Data

US 2012/0328313 A1 Dec. 27, 2012

(30) Foreign Application Priority Data

Jun. 23, 2011 (JP) ..... 2011-139054

(51) Int. Cl.
*G03G 15/06* (2006.01)
*G03G 15/08* (2006.01)
*G03G 15/09* (2006.01)

(52) U.S. Cl.
CPC ..... *G03G 15/0808* (2013.01); *G03G 15/0907* (2013.01)
USPC ..... 399/55

(58) Field of Classification Search
USPC ..... 399/55, 49, 257
See application file for complete search history.

(56) References Cited

U.S. PATENT DOCUMENTS

| | | | | |
|---|---|---|---|---|
| 5,512,981 | A * | 4/1996 | Hirsch | 399/49 |
| 6,006,048 | A * | 12/1999 | Folkins | 399/55 |
| 7,349,653 | B2 * | 3/2008 | Nishihama et al. | 399/223 |
| 2003/0049054 | A1 * | 3/2003 | Ozawa et al. | 399/272 |
| 2004/0002015 | A1 | 1/2004 | Ozawa et al. | |

FOREIGN PATENT DOCUMENTS

| | | |
|---|---|---|
| JP | 2003-280392 | 10/2003 |
| JP | 2005-55837 | 3/2005 |
| JP | 2005-55839 | 3/2005 |
| JP | 2007-322716 | 12/2007 |

* cited by examiner

*Primary Examiner* — Quana M Grainger
(74) *Attorney, Agent, or Firm* — Gerald E. Hespos; Michael J. Porco; Matthew T. Hespos

(57) ABSTRACT

An image forming apparatus includes a magnetic roller voltage applier for a magnetic roller, a developing roller voltage applier for a developing roller and a controller for controlling the appliers. The controller controls the magnetic roller voltage applier to apply, to the magnetic roller, a first voltage for forcibly conveying a thin layer of toner held on the developing roller toward the magnetic roller for a first period required for one turn of the developing roller, and controls the developing roller voltage applier to apply, to the developing roller, a second voltage for causing toner on the developing roller to fly onto the image carrier for a second period when at least the forcible consumption electrostatic latent image faces a facing portion between the developing roller and the magnetic roller. At least parts of the first period and the second period are overlapped with each other.

4 Claims, 7 Drawing Sheets

IMAGE FORMING APPARATUS USING TWO-COMPONENT DEVELOPER AND HAVING CONTROLLED TIMING OF APPLICATION OF VOLTAGE TO MAGNETIC ROLLER

This application is based on Japanese Patent Application No. 2011-139054 filed on Jun. 23, 2011, the contents of which are hereby incorporated by reference.

BACKGROUND

The present disclosure relates to an electrophotography type image forming apparatus, and more particularly to an image forming apparatus using a two-component developer including carrier and toner, and adapted to develop an electrostatic latent image by holding only the toner on a developing roller.

There are known a single-component developing method and a two-component developing method, as a developing method for an electrophotography type image forming apparatus. In the single-component developing method using a developer only composed of toner, a magnetic brush composed of carrier and toner is not formed. Accordingly, there is no likelihood that an electrostatic latent image on a photosensitive drum may be disturbed by the magnetic brush. Thus, the single-component developing method is suitable for high quality image formation, as compared with the two-component developing method.

The single-component developing method, however, has a difficulty in stably maintaining a charging amount of toner for a long period, as compared with the two-component developing method. Further, in the case where a color toner is used, the toner is required to have a light transmittance. In view of this, the toner is required to be non-magnetic toner, which makes it further difficult to stably maintain a charging amount of toner. Therefore, in most of the cases, the two-component developing method using carrier as a medium for charging and conveying toner is employed for a full-color image forming apparatus.

The two-component developing method is suitable for a longtime use of toner, because a stable charging amount is secured for a long period. However, the two-component developing method is not advantageous in the aspect of image quality, as compared with the single-component developing method, because the aforementioned magnetic brush adversely affects the image formation.

In recent years, there has been noticed a touchdown developing method having the advantages of both of the single-component developing method and the two-component developing method. In the touchdown developing method, a magnetic brush is formed on the surface of a magnetic roller by a two-component developer containing toner and carrier, and a thin layer of toner is formed on the surface of a developing roller by conveying only the toner from the magnetic brush. Then, the toner is caused to fly from the thin layer of toner onto the surface of a photosensitive drum where an electrostatic latent image is formed for developing the electrostatic latent image into a toner image. The touchdown developing method is advantageous in securing a longtime use of toner by applying the two-component developing method to a toner charging region, and in securing a high-quality image by applying the single-component developing method to a developing region.

The touchdown developing method, however, involves the following problem. A thin layer of toner is formed on the developing roller by using a magnetic brush and application of a bias voltage. As the bias voltage in one direction of electric field is continued to be applied to the developing roller, toner is adhered to the developing roller. Further, there occurs a developing ghost (hysteresis) phenomenon that a ghost image after fly of toner from the developing roller onto the photosensitive drum appears at a second turn of the photosensitive drum. To prevent such a phenomenon, it is necessary to perform a so-called refreshing operation of peeling off the thin layer of toner that has been formed on the developing roller, and forming another thin layer of toner on the developing roller. As the method for performing the refreshing operation, there are known a first method of peeling off a thin layer of toner by e.g. a blade or an elastic roller, and a second method of peeling off a thin layer of toner by applying a bias voltage in an interval between an image formation for a preceding sheet and an image formation for a succeeding sheet to generate a reverse potential difference between the developing roller and the magnetic roller.

Further, if a condition that the printing rate of an image to be formed is low is continued for a certain period, the amount of toner to be conveyed from the developing roller onto the photosensitive drum decreases. Deterioration of toner resulting from a longtime holding of the toner on the developing roller may cause various image-related problems such as image density lowering or a fogged image. In a conventional image forming apparatus, the image printing rate is calculated, and if the calculated image printing rate is lower than a predetermined rate, toner is forcibly consumed in an interval between image formations for preceding and succeeding sheets, in other words, toner on the developing roller is caused to forcibly fly from the developing roller onto an electrostatic latent image formed on the photosensitive drum, for conveying toner from the magnetic roller onto the developing roller by the amount of toner that has been caused to forcibly fly onto the electrostatic latent image. Thus, a thin layer of toner is constantly formed by supply of fresh toner from the magnetic roller.

Conventionally, a peeling off operation of peeling off a thin layer of toner has been performed after completion of a forcible consuming operation of forcibly consuming toner for stably performing the peeling off operation and the forcible consuming operation between image formations for preceding and succeeding sheets. It is necessary to set the interval between image formations for preceding and succeeding sheets long for performing the peeling-off operation and the forcible consuming operation. This necessitates raising the system speed to meet a processing speed required by the apparatus specifications. Raising the processing speed, however, results in a problem such as toner fly.

In view of the above, an object of the present disclosure is to efficiently perform a peeling off operation and a forcible consuming operation in a touchdown developing method, with a reduced interval between image formations for preceding and succeeding sheets.

SUMMARY

An image forming apparatus according to an aspect of the present disclosure includes a magnetic roller, a developing roller, an image carrier, an exposure device, a magnetic roller voltage applier for applying a voltage to the magnetic roller, a developing roller voltage applier for applying a voltage to the developing roller, and a controller.

The magnetic roller conveys a two-component developer including toner and carrier. The developing roller holds a thin layer of toner formed of the toner conveyed from the magnetic roller, on a facing portion between the magnetic roller and the developing roller. The image carrier carries an electrostatic latent image on a surface thereof for carrying a toner image which is formed by causing toner in the thin layer of toner to fly onto the electrostatic latent image from the facing portion between the image carrier and the developing roller. The exposure device irradiates light onto the surface of the image carrier for forming the electrostatic latent image. The controller controls the magnetic roller voltage applier and the developing roller voltage applier to respectively apply voltages, and controls the exposure device to form a forcible consumption electrostatic latent image by forcibly conveying toner on the developing roller onto the image carrier.

The controller controls the magnetic roller voltage applier to apply, to the magnetic roller, a first voltage for forcibly conveying the thin layer of toner held on the developing roller toward the magnetic roller for a first period required for one turn of the developing roller. Further, the controller controls the developing roller voltage applier to apply, to the developing roller, a second voltage for causing the toner on the developing roller to fly therefrom onto the image carrier for a second period when at least the forcible consumption electrostatic latent image faces the developing roller at the facing portion. The controller controls the magnetic roller voltage applier and the developing roller voltage applier in such a manner that at least a part of the first period and a part of the second period are overlapped with each other.

These and other objects, features and advantages of the present disclosure will become more apparent upon reading the following detailed description along with the accompanying drawings.

DETAILED DESCRIPTION

Figure 1:
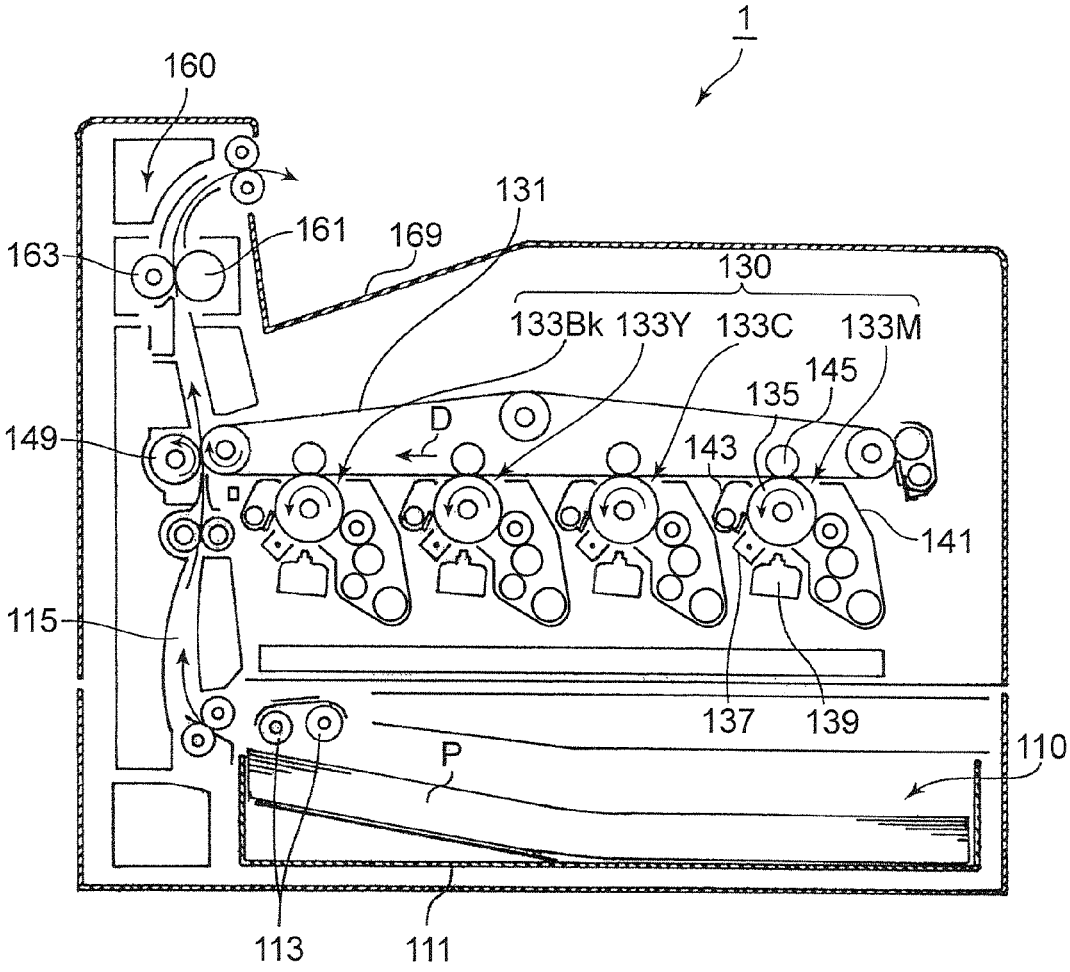
FIG. 1 is a cross-sectional view showing an internal structure of an image forming apparatus embodying the present disclosure.

In the following, an embodiment of the present disclosure is described referring to the drawings. FIG. 1 is a diagram schematically showing an internal structure of an image forming apparatus 1 in the embodiment of the present disclosure. In this embodiment, there is described a color printer, as an example of the image forming apparatus. Alternatively, the image forming apparatus may be a monochromatic printer. Further alternatively, the present disclosure may be applied to a complex machine equipped with the functions of e.g. a facsimile machine and a copier, in addition to the printer.

The image forming apparatus 1 is a tandem-type color printer. The image forming apparatus 1 is provided with a sheet storage portion 110, an image forming portion 130 and a fixing portion 160. The sheet storage portion 110 is disposed at a lowermost position of the image forming apparatus 1. The sheet storage portion 110 is provided with a sheet tray 111 capable of storing a stack of sheets P. The sheet tray 111 is insertably mounted on the image forming apparatus 1. When sheets P are replenished, the sheet tray 111 is drawn out of the image forming apparatus 1. An uppermost sheet P of the stack of sheets P stored in the sheet tray 111 is dispensed and fed toward a sheet transport path 115 by driving a pickup roller 113. The sheet P is transported to the image forming portion 130 via the sheet transport path 115.

The image forming portion 130 is adapted to form a toner image onto the sheet P transported to the image forming portion 130. The image forming portion 130 is provided with an image forming unit 133M for forming a magenta toner image, an image forming unit 133C for forming a cyan toner image, an image forming unit 133Y for forming a yellow toner image and an image forming unit 133Bk for forming a black toner image. The image forming units 133M, 133C, 133Y and 133Bk are tandemly arranged in the order of transferring the toner images onto a transfer belt 131. Since the image forming units 133M, 133C, 133Y and 133Bk have the same arrangement as each other, in this section, the image forming unit 133M for forming a magenta toner image is described as a representative example.

The image forming unit 133M has a photosensitive drum 135 (image carrier). The photosensitive drum 135 has a cylindrical circumferential surface, and an electrostatic latent image is formed on the circumferential surface of the photosensitive drum 135. The photosensitive drum 135 carries thereon a toner image developed by supplying toner onto the electrostatic latent image.

A charger 137, an exposure device 139, a developing device 141 and a cleaner 143 are arranged around the photosensitive drum 135. The charger 137 uniformly charges the circumferential surface of the photosensitive drum 135. The exposure device 139 generates light corresponding to magenta data, out of image data transmitted from e.g. a personal computer, and irradiates the light onto the uniformly charged circumferential surface of the photosensitive drum 135. By performing the above operation, an electrostatic latent image corresponding to the magenta data is formed on the circumferential surface of the photosensitive drum 135. When magenta toner is supplied from the developing device 141 onto the circumferential surface of the photosensitive drum 135 in this state, a toner image corresponding to the magenta data is formed on the circumferential surface of the photosensitive drum 135.

The transfer belt 131 is circulated in D-direction (clockwise) in a state that the transfer belt 131 is interposed between the photosensitive drum 135 and a primary transfer roller 145. The toner image corresponding to magenta data is transferred from the photosensitive drum 135 onto the transfer belt 131. Residues of magenta toner on the circumferential surface of the photosensitive drum 135 are removed by the cleaner 143. The image forming unit 133M is operated as described above.

After the toner image corresponding to magenta data is transferred onto the transfer belt 131 as described above, a toner image corresponding to cyan data, a toner image corresponding to yellow data, and a toner image corresponding to black data are successively transferred one over the other onto the toner image corresponding to magenta data. By performing the above operation, a full-color toner image is formed on the transfer belt 131. The full-color toner image is transferred onto a sheet P transported from the sheet storage portion 110 by a secondary transfer roller 149.

The sheet P carrying a transferred full-color toner image is fed to the fixing portion 160. The fixing portion 160 is provided with a heating roller 161 and a pressing roller 163. The sheet P carrying a transferred full-color toner image is held between the heating roller 161 and the pressing roller 163. Then, heat and pressure are applied to the sheet P carrying a transferred full-color toner image, and the full-color toner image is fixed on the sheet P. Thereafter, the sheet P is discharged to a sheet discharge portion 169.

Figure 2:
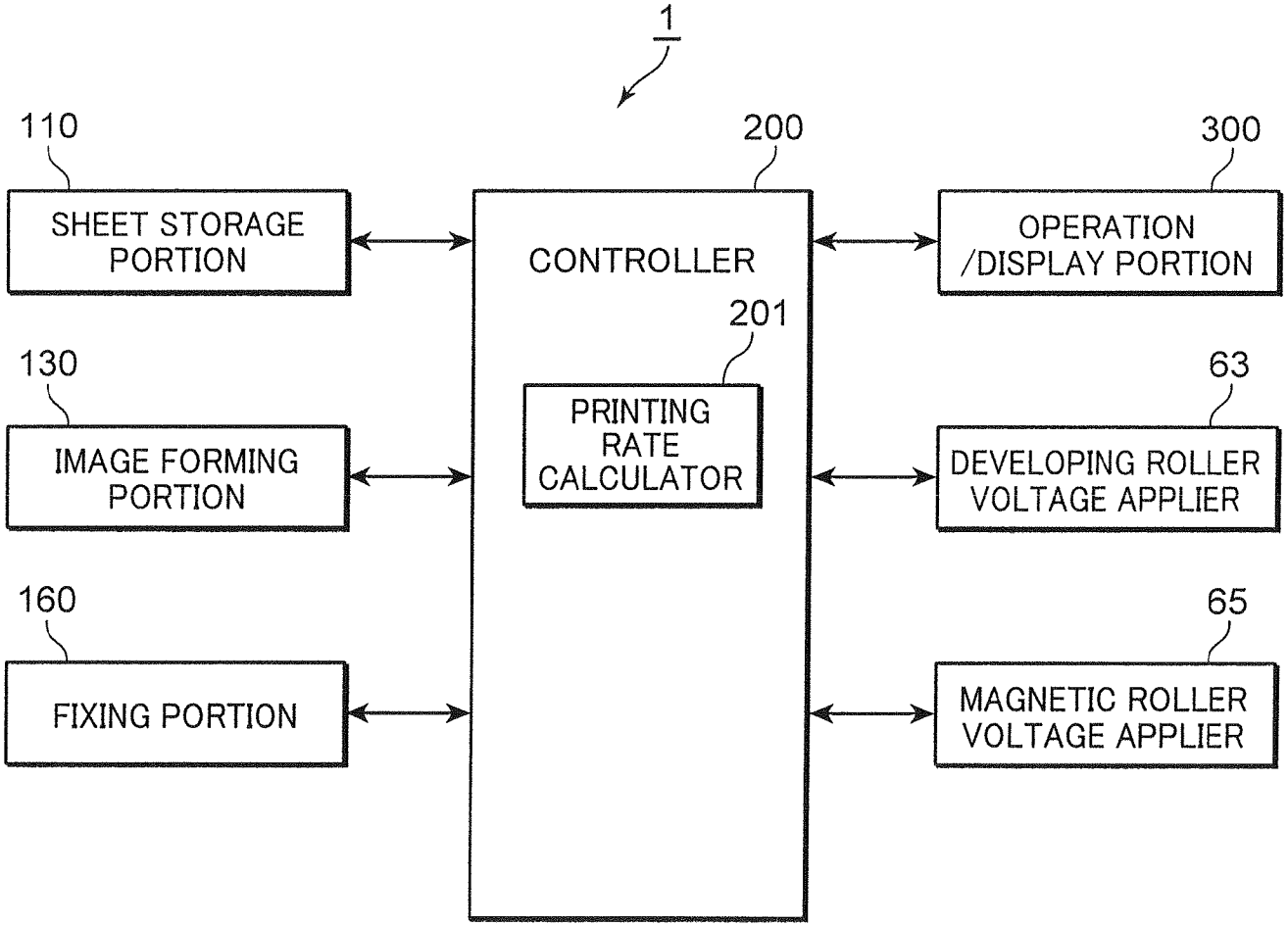
FIG. 2 is a block diagram showing an electrical configuration of the image forming apparatus.

FIG. 2 is a block diagram showing an electrical configuration of the image forming apparatus 1. The image forming apparatus 1 is constructed in such a manner that the sheet storage portion 110, the image forming portion 130, the fixing portion 160, a controller 200, an operation/display portion 300, a developing roller voltage applier 63, and a magnetic roller voltage applier 65 are connected to each other via a bus line. Since the sheet storage portion 110, the image forming portion 130 and the fixing portion 160 have been described as above referring to FIG. 1, the description thereof is omitted herein.

The controller 200 is composed of a CPU (Central Processing Unit), an ROM (Read Only Memory), an RAM (Random Access Memory) and an image memory, and controls the aforementioned hardware components constituting the image forming apparatus 1 to perform controls necessary for operating the image forming apparatus 1. The ROM stores a software program necessary for controlling the operation of the image forming apparatus 1. The RAM is used for e.g. temporarily storing data generated in the course of executing a software program, and storing application software programs. The image memory temporarily stores image data (such as image data transmitted from a personal computer).

The operation/display portion 300 is provided with operation keys and a display screen. Contents on various manipulations and operations are displayed on the display screen.

The developing roller voltage applier 63 (developing roller voltage applier) and the magnetic roller voltage applier 65 (magnetic roller voltage applier) each generates a bias voltage obtained by superimposing a direct current voltage and an alternate current voltage for applying the respective bias voltages to a developing roller 11 and to a magnetic roller 13 (see FIG. 3) provided in the developing device 141.

A printing rate calculator 201 counts the number of sheets for which image formation has been carried out during a predetermined period (e.g. twenty-four hours), an accumulated developing/driving time in the predetermined period and the sum of dots formed on the sheets in the predetermined period, and calculates an average printing rate with respect to the formed images, based on these values.

Figure 3:
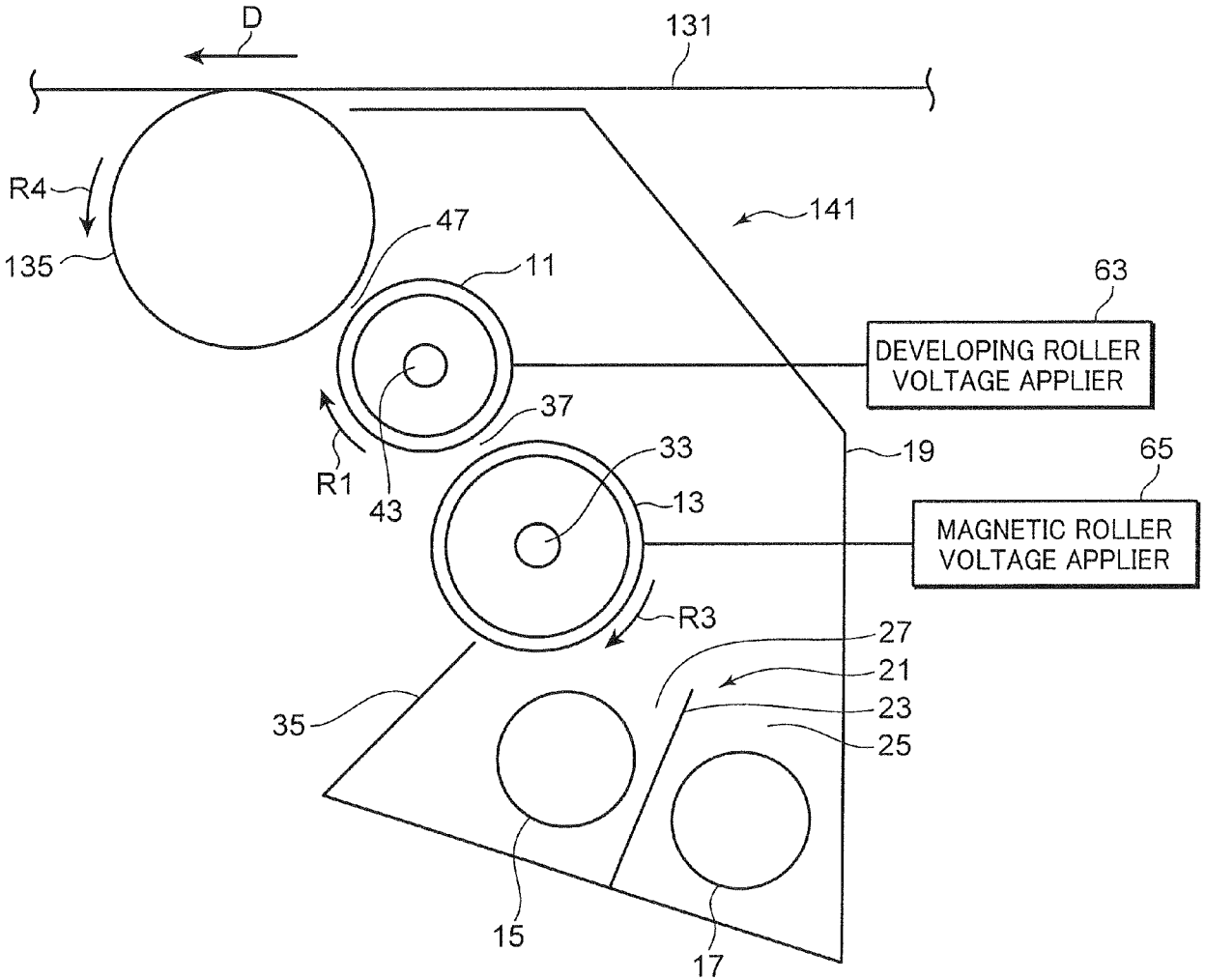
FIG. 3 is a schematically cross-sectional view of a photosensitive drum and a developing device.

Next, the construction and the operation of the developing device 141 are described. FIG. 3 is a cross-sectional view of a pair of a photosensitive drum 135 and a developing device 141. The photosensitive drum 135 is an example of an image carrier, and the developer used in the developing device 141 is a two-component developer. The illustration of toner and carrier composing the two-component developer is omitted herein.

The developing device 141 is provided with a developing roller 11, a magnetic roller 13, agitation screws 15 and 17, and a housing unit 19 for housing these parts therein. The agitation screws 15 and 17 are disposed in an agitation chamber 21 within the housing unit 19. The agitation chamber 21 is divided into two spaces i.e. agitation spaces 25 and 27 by a partition plate 23. The agitation screw 17 is disposed in the agitation space 25, and the agitation screw 15 is disposed in the agitation space 27. A two-component developer is accommodated in the agitation spaces 25 and 27.

The two-component developer is agitated by rotating the agitations screws 15 and 17. By performing the above operation, toner and carrier are frictionally charged, and are brought to a state that the toner and the carrier are electrostatically coupled to each other. The two-component developer accommodated in the agitation space 27 is magnetically attracted to the magnetic roller 13, out of the two-component developer in the electrostatically coupled state.

The magnetic roller 13 is a roller for conveying the two-component developer, and is disposed in the housing unit 19 at such a position as to face the agitation screw 15 and the developing roller 11. The magnetic roller 13 faces the developing roller 11 at a portion indicated by the reference sign 37 (hereinafter, called as the facing portion 37). The magnetic roller 13 has a cylindrical shape, and a shaft 33 is rotatably disposed in the hollow cylindrical portion of the magnetic roller 13. The magnetic roller 13 is rotated in a rotating direction R3 by rotating the shaft 33.

A series of magnets constituted of magnets having a north pole and magnets having a south pole are alternately arranged along the rotating direction R3 within the magnetic roller 13. A magnetic field for magnetically attracting the two-component developer in a state of a magnetic brush is formed by a magnetic force of these magnets. When the magnetic roller 13 is rotated in the rotating direction R3 while magnetically attracting the two-component developer in the state of a magnetic brush, the two-component developer is conveyed to the facing portion 37. During the conveying operation, the thickness of the two-component developer held on the magnetic roller 13 is restricted by a blade 35.

The magnetic roller voltage applier 65 generates a bias voltage obtained by superimposing a direct current voltage and an alternate current voltage for applying the bias voltage to the magnetic roller 13. Since the carrier is magnetically attracted to the magnetic roller 13, only the toner is conveyed onto the developing roller 11 by a potential difference between the magnetic roller 13 and the developing roller 11, resulting from application of the bias voltage.

The developing roller 11 is disposed at such a position as to face the photosensitive drum 135 at a position corresponding to a facing portion 47. The developing roller 11 has a cylindrical shape, and a shaft 43 is rotatably disposed in the hollow cylindrical portion of the developing roller 11. The developing roller 11 is rotated in a rotating direction R1 by rotating the shaft 43.

The developing roller 11 holds thereon a thin layer of toner formed of the toner conveyed from the magnetic roller 13 on the facing portion 37, and conveys the thin layer of toner by rotating the developing roller 11 in the rotating direction R1. The developing roller voltage applier 63 generates a bias voltage obtained by superimposing a direct current voltage and an alternate current voltage for applying the bias voltage to the developing roller 11. The toner to be conveyed by the developing roller 11 is caused to fly onto the electrostatic latent image carried on the photosensitive drum 135 by the potential difference between the developing roller 11 and the photosensitive drum 135, resulting from application of the aforementioned bias voltage to the developing roller 11. By performing the above operation, the electrostatic latent image is developed into a toner image.

The transfer belt 131 is disposed on the photosensitive drum 135 in such a manner as to contact with the circumferential surface of the photosensitive drum 135. The transfer belt 131 is circulated in D-direction, and a toner image is transferred onto the transfer belt 131 at a nip portion between the photosensitive drum 135 and the transfer belt 131.

Figure 4:
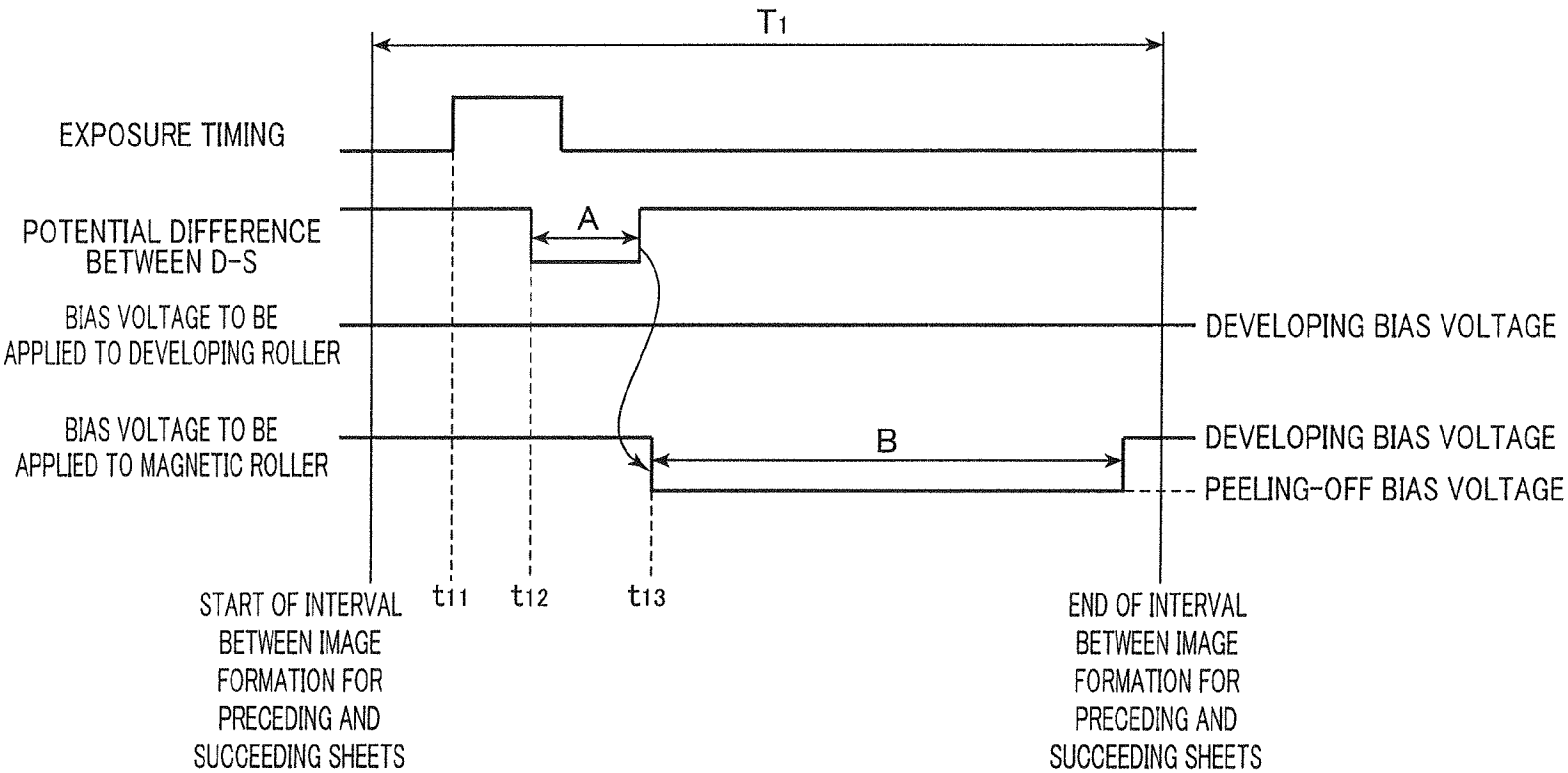
FIG. 4 is a timing chart showing a peeling-off operation and a forcible consuming operation as a comparative example.

Next, a peeling-off operation and a forcible consuming operation to be performed in an interval between image formations for preceding and succeeding sheets are described. FIG. 4 is a timing chart showing a peeling-off operation and a forcible consuming operation as a comparative example of the embodiment. FIGS. 5A to 5D are diagrams for describing the peeling-off operation and the forcible consuming operation as the comparative example. FIG. 4 shows from the upper side, an exposure timing, a potential difference between the developing roller 11 and the photosensitive drum 135 (hereinafter, called as between D-S) on the facing portion 47, a bias voltage to be applied to the developing roller 11 and a bias voltage to be applied to the magnetic roller 13.

Figure 5A:
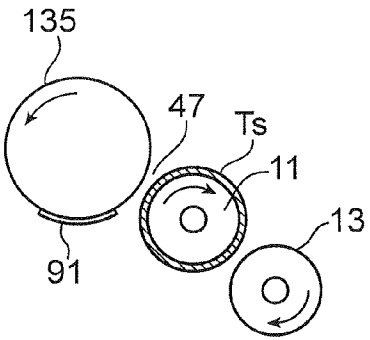
FIGS. 5A, 5B, 5C and 5D are diagrams for describing the peeling-off operation and the forcible consuming operation as the comparative example.
Figure 5B:
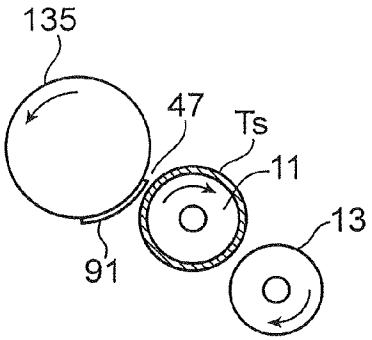
Figure 5C:
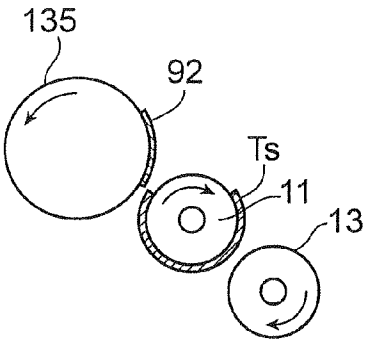

In the comparative example, the developing roller voltage applier 63 constantly applies a developing bias voltage to the developing roller 11 in the interval between image formations for preceding and succeeding sheets. At a timing t11, the exposure device 139 irradiates light for forming a forcible consumption electrostatic latent image (e.g. an electrostatic latent image for forming a toner image corresponding to a raw image) on the circumferential surface of the photosensitive drum 135. By performing the exposure operation, as shown in FIG. 5A, a forcible consumption electrostatic latent image 91 is formed on the circumferential surface of the photosensitive drum 135.

When an upstream end of the electrostatic latent image reaches the facing portion 47 by the rotation of the photosensitive drum 135 (at a timing t12, see FIG. 5B), toner Ts is caused to fly from the thin layer of toner held on the developing roller 11 onto the electrostatic latent image 91 because a developing bias voltage is applied to the developing roller 11. Then, the electrostatic latent image 91 is developed into a toner image 92, and the toner image 92 is held on the photosensitive drum 135. A period when the electrostatic latent image 91 faces the developing roller 11, namely, a period when the potential difference between D-S is set to a low level as shown by the arrow A, is a period (forcible consumption period) when the toner Ts on the developing roller 11 is conveyed onto the photosensitive drum 135 for forcible consumption.

Then, when a downstream end of the forcible consumption electrostatic latent image 91 passes the facing portion 47 by the rotation of the photosensitive drum 135 (see FIG. 5C), the conveyance of toner from the developing roller 11 onto the photosensitive drum 135 is stopped. Thereafter, as the photosensitive drum 135 is further rotated, the toner image 92 is removed by the cleaner 143 (see FIG. 1).

Figure 5D:
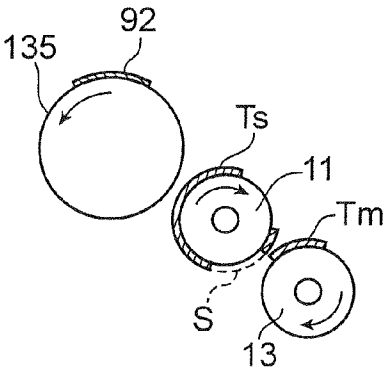

In response to passing of the forcible consumption electrostatic latent image 91 over the facing portion 47 (in response to setting of the potential difference between D-S to a high level), the magnetic roller voltage applier 65 switches the voltage to be applied to the magnetic roller 13 from a developing bias voltage to a peeling-off bias voltage (at a timing t13). The peeling-off bias voltage is a bias voltage to be applied to the magnetic roller 13 so that the magnetic roller 13 is operable to electrically attract (peel off) the toner Ts from the developing roller 11. When the peeling-off bias voltage is applied to the magnetic roller 13, the toner Ts is conveyed from the developing roller 11 onto the magnetic roller 13 (see FIG. 5D). Referring to FIG. 5D, the area S indicated by the dotted line is an area where toner is peeled off by the magnetic roller 13, and toner Tm on the magnetic roller 13 is toner that has been peeled off from the developing roller 11.

The magnetic roller voltage applier 65 applies a peeling-off bias voltage to the magnetic roller 13 for a period (a period indicated by the arrow B) required for one turn of the developing roller 11 from the timing t13, for conveying the residues of toner Ts on the developing roller 11 onto the magnetic roller 13 after the forcible consuming operation is completed. In other words, the period indicated by the arrow B is a period for a peeling-off operation. The toner Ts on the developing roller 11 is conveyed onto the photosensitive drum 135 or onto the magnetic roller 13 in the aforementioned manner. Referring to FIG. 4, a period T1 indicates a period required for performing a refreshing operation.

As described above, in the conventional art as represented by the comparative example, a peeling-off operation is performed after a forcible consuming operation is completed. This necessitates setting the interval between image formations for preceding and succeeding sheets long for securing a time required for a refreshing operation. It is necessary to provide a measure for raising the system speed by the speed corresponding to an increase in the interval between image formations for preceding and succeeding sheets in order to secure an intended processing speed for image formation while securing a sufficient interval between image formations for preceding and succeeding sheets. Raising the system speed, however, results in a problem such as toner fly.

Figure 6:
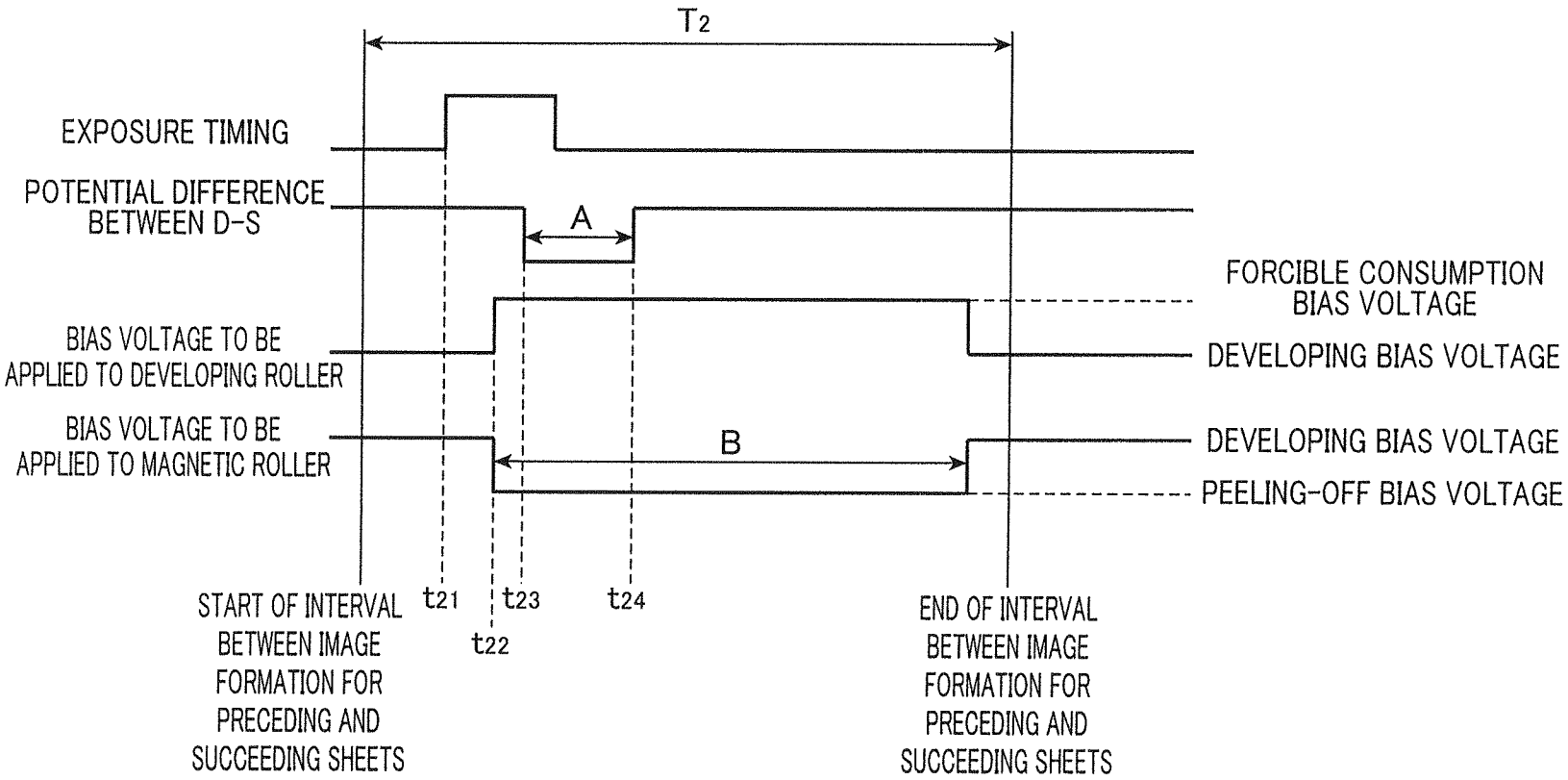
FIG. 6 is a timing chart showing a peeling-off operation and a forcible consuming operation in the embodiment of the present disclosure.
Figure 7A:
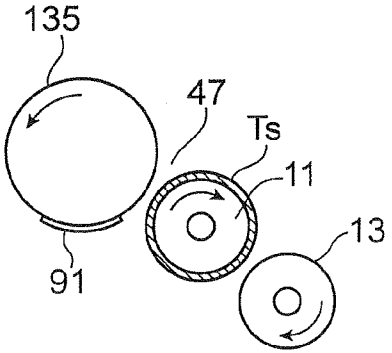
FIGS. 7A, 7B and 7C are diagrams for describing the peeling-off operation and the forcible consuming operation in the embodiment of the present disclosure.
Figure 7B:
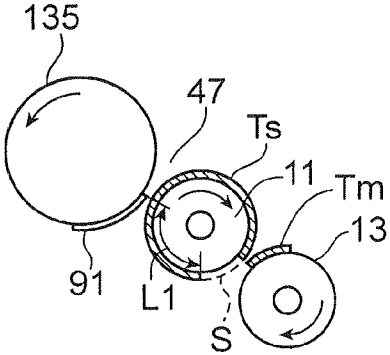
Figure 7C:
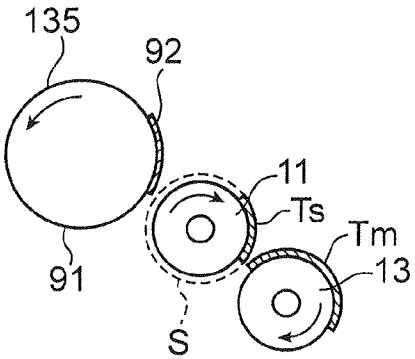

Next, a peeling-off operation and a forcible consuming operation to be performed by the image forming apparatus 1 in the present disclosure are described. FIG. 6 is a timing chart showing a peeling-off operation and a forcible consuming operation to be performed in the embodiment of the present disclosure. FIGS. 7A to 7C are diagrams for describing the peeling-off operation and the forcible consuming operation to be performed in the embodiment.

At a timing t21, the exposure device 139 irradiates light onto the circumferential surface of the photosensitive drum 135 for forming a forcible consumption electrostatic latent image. By performing the exposure operation, as shown in FIG. 7A, a forcible consumption electrostatic latent image 91 is formed on the circumferential surface of the photosensitive drum 135. When the forcible consumption electrostatic latent image 91 is formed, the developing roller voltage applier 63 applies a developing bias voltage to the developing roller 11.

Then, the developing roller voltage applier 63 applies, to the developing roller 11, a forcible consumption bias voltage (second voltage) larger than the developing bias voltage (at a timing t22). Simultaneously, the magnetic roller voltage applier applies a peeling-off bias voltage (first voltage) to the magnetic roller 13 for a period (a period indicted by the arrow B) required for one turn of the developing roller 11 from the timing t22. By performing the above operation, toner Ts on the developing roller 11 is conveyed onto the magnetic roller 13. The period indicated by the arrow B is a peeling-off period (first period).

It should be appreciated that the application start timings (and the application end timings) of the forcible consumption bias voltage and the peeling-off bias voltage may not necessarily coincide with each other. However, making the application start timings (and the application end timings) coincide with each other simplifies the controls of the developing roller voltage applier 63 and the magnetic roller voltage applier 65 by the controller 200, and reduces the processing load of the controller 200. In other words, the embodiment shown in FIG. 6, wherein a forcible consuming operation and a peeling-off operation are executed in a state that the forcible consumption period and the peeling-off period are completely overlapped with each other is one of the most preferred embodiments. Further, completely overlapping the period (first period) required for the peeling-off operation, and the period (second period) required for the forcible consumption operation means that the peeling-off operation and the forcible consumption operation are completely concurrently executed. Completely concurrently executing the peeling-off operation and the forcible consumption operation is further advantageous in shortening the period for a refreshing operation, and in setting the interval between image formations for preceding and succeeding sheets short.

Further, the absolute value of a direct current component of the forcible consumption bias voltage is set larger than the absolute value of a direct current component of the developing bias voltage. Since the forcible consumption bias voltage and the peeling-off bias voltage are simultaneously applied, the developing roller 11 may be affected by the peeling-off bias voltage in the range of from about several voltages to several ten voltages. Setting the absolute value of a direct current component of the forcible consumption bias voltage larger than the absolute value of a direct current component of the developing bias voltage generates a condition that toner is likely to be caused to fly onto the forcible consumption electrostatic latent image 91 without being affected by the peeling-off bias voltage.

When the upstream end of the forcible consumption electrostatic latent image 91 reaches the facing portion 47 (at a timing t23, see FIG. 7B), toner is caused to fly from the developing roller 11 onto the electrostatic latent image 91. A period (a period indicated by the arrow A when the potential difference between D-S is set to a low level) when the electrostatic latent image 91 faces the developing roller 11 is the forcible consumption period (second period) when the toner Ts on the developing roller 11 is conveyed onto the photosensitive drum 135.

Since the peeling-off bias voltage is applied to the magnetic roller 13, the peeling-off operation is performed concurrently with the forcible consuming operation. The area S in FIG. 7B indicates an area where toner has been peeled off by the magnetic roller 13 during a period from the timing t22 to the timing t23. Further, toner Tm on the magnetic roller 13 indicates toner that has been peeled off from the developing roller 11.

In the following, an application start timing of the peeling-off bias voltage at the timing t22 is described. It is necessary to cause the toner Ts on the developing roller 11 to sufficiently fly onto the forcible consumption electrostatic latent image 91. If, however, the application start timing of the peeling-off bias voltage is earlier than an appropriate timing, the magnetic roller 13 may peel off the toner Ts that should be caused to fly onto the electrostatic latent image 91, before the electrostatic latent image 91 reaches the facing portion 47. This may result in an incomplete forcible consuming operation.

In view of the above, the magnetic roller voltage applier 65 is controlled to start applying the peeling-off bias voltage while leaving the toner Ts by a length L1 facing the electrostatic latent image 91 along the rotating direction of the developing roller 11 (in other words, the toner Ts that should be caused to fly onto the forcible consumption electrostatic latent image 91), on a downstream portion of the developing roller 11 with respect to the facing portion 47, when the forcible consumption electrostatic latent image 91 reaches the facing portion 47.

Specifically, the controller 200 calculates the length L1, using e.g. a length of the forcible consumption electrostatic latent image 91 along the rotating direction of the photosensitive drum 135, a length from an exposure position of the photosensitive drum 135 to the facing portion 47, and the rotation speeds of the photosensitive drum 135 and the developing roller 11. Then, the controller 200 determines an application start timing of the peeling-off bias voltage by the magnetic roller voltage applier 65 in such a manner that the toner Ts (thin layer of toner) by the length L1 is left on the downstream portion of the developing roller 11 with respect to the facing portion 47 at the point of time when the forcible consumption electrostatic latent image 91 reaches the facing portion 47. The length of the forcible consumption electrostatic latent image along the rotating direction of the photosensitive drum 135 is determined by the controller 200 in accordance with the printing rate calculated by the printing rate calculator 201.

In this embodiment, as shown in FIG. 6, the magnetic roller voltage applier 65 starts applying the peeling-off bias voltage before the upstream end of the forcible consumption electrostatic latent image 91 reaches the facing portion 47 (before the potential difference between D-S is set to the low level). The application start timing of the peeling-off bias voltage is not limited to the above. As described above, the application start timing of the peeling-off bias voltage varies depending on e.g. the length of the forcible consumption electrostatic latent image 91 along the rotating direction of the photosensitive drum 135, the length from the exposure position of the photosensitive drum 135 to the facing portion 47, or the rotation speeds of the photosensitive drum 135 and the developing roller 11.

Holding the toner Ts by a length longer than the length L1 on the developing roller 11 at the point of time when the forcible consumption electrostatic latent image reaches the facing portion 47 means that the end point of time of the refreshing operation is delayed by the period corresponding to the extended length. In view of this, it is desirable for the controller 200 to determine the application start timing of the peeling-off bias voltage in such a manner that toner Ts by the length L1 is left on the downstream portion of the magnetic roller 13 with respect to the facing portion 47 at the point of time when the forcible consumption electrostatic latent image 91 reaches the facing portion 47. This is advantageous in shortening the interval between image formations for preceding and succeeding sheets, because the forcible consuming operation and the peeling-off operation are efficiently and concurrently executed.

When the downstream end of the forcible consumption electrostatic latent image 91 reaches the facing portion 47 (at a timing t24, see FIG. 7C), the conveyance of toner from the developing roller 11 onto the photosensitive drum 135 is stopped. Referring to FIG. 7C, the area S indicated by the dotted line shows an area where the toner that has been peeled off by the magnetic roller 13 and the toner that has been caused to fly onto the photosensitive drum 135 have been held. The magnetic roller voltage applier 65 continues to apply the peeling-off bias voltage to the magnetic roller 13 by the period required for one turn of the developing roller 11. Accordingly, the toner Ts remaining on the developing roller 11 is peeled off by the magnetic roller 13. Further, a toner image 92 on the photosensitive drum 135 is removed by the cleaner 143.

A period T2 shown in FIG. 6 indicates a period required for the refreshing operation when the present disclosure is applied. FIG. 6 clearly shows that the refreshing period is remarkably shortened, as compared with the period T1 shown in FIG. 4.

In the control of the conventional comparative example, the peeling-off operation is performed after the forcible consuming operation is completed. This necessitates setting the interval between image formations for preceding and succeeding sheets long. In this embodiment, however, at least a part of the period (first period) required for the peeling-off operation and a part of the period (second period) required for the forcible consuming operation are overlapped with each other, in other words, the forcible consuming operation and the peeling-off operation are concurrently executed. This shortens the period required for the refreshing control to thereby reduce the interval between image formations for preceding and succeeding sheets by the period corresponding to the shortened period. Further, a reduction in the interval between image formations for preceding and succeeding sheets enables to lower the system speed. This is advantageous in suppressing toner fly.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

a magnetic roller which conveys a two-component developer including toner and carrier;

a developing roller which holds a thin layer of toner formed by the toner conveyed from the magnetic roller on a facing portion between the magnetic roller and the developing roller;

an image carrier which carries an electrostatic latent image on a surface thereof for carrying a toner image, the toner image being formed by causing toner in the thin layer of toner to fly onto the electrostatic latent image at the facing portion between the image carrier roller and the developing roller;

an exposure device which irradiates light onto the surface of the image carrier for forming the electrostatic latent image;

a magnetic roller voltage applier which applies a voltage to the magnetic roller;

a developing roller voltage applier which applies a voltage to the developing roller; and a controller which controls the magnetic roller voltage applier and the developing roller voltage applier to apply the respective voltages, and which controls the exposure device to form a forcible consumption electrostatic latent image for forcibly conveying toner on the developing roller onto the image carrier, wherein the controller controls the magnetic roller voltage applier to apply, to the magnetic roller, a first voltage for forcibly conveying the thin layer of toner held on the developing roller toward the magnetic roller for a first period required for one turn of the developing roller, the controller controls the developing roller voltage applier to apply, to the developing roller, a second voltage for causing the toner on the developing roller to fly therefrom onto the image carrier for a second period when at least the forcible consumption electrostatic latent image faces the developing roller at the facing portion, and the controller controls the magnetic roller voltage applier and the developing roller voltage applier in such a manner that at least a part of the first period and a part of the second period are overlapped with each other and controls the magnetic roller voltage applier to start applying the first voltage to the magnetic roller, after a thin layer of toner that is caused to fly onto the forcible electrostatic latent image, out of the thin layer of toner held on the developing roller, passes the facing portion between the developing roller and the magnetic roller.

2. The image forming apparatus according to claim 1, wherein the controller controls the magnetic roller voltage applier and the developing roller voltage applier in such a manner that the first period and the second period are completely overlapped with each other.

3. The image forming apparatus according to claim 1, wherein the controller calculates a length L1 required for the thin layer of toner, using at least a length of the forcible consumption electrostatic latent image along a rotating direction of the image carrier, a length from an exposure position of the image carrier to the facing portion, a rotation speed of the image carrier and a rotation speed of the developing roller, and the controller determines an application start timing of the first voltage to be applied by the magnetic roller voltage applier in such a manner that the thin layer of toner by the length L1 is left on a downstream portion of the developing roller with respect to the facing portion at a point of time when the forcible consumption electrostatic latent image reaches the facing portion.

4. The image forming apparatus according to claim 1, wherein an absolute value of a direct current component of the second voltage is set larger than an absolute value of a direct current component of a developing bias voltage to be applied by the developing roller voltage applier when an image is printed on a sheet.

* * * * *